US007414209B2

(12) United States Patent
Tsuruoka et al.

(10) Patent No.: US 7,414,209 B2
(45) Date of Patent: Aug. 19, 2008

(54) LIQUID LEVEL SENSOR SWITCH

(75) Inventors: Hiroyuki Tsuruoka, Saitama (JP); Sadayoshi Oshima, Saitama (JP); Yuichi Auchi, Saitama (JP)

(73) Assignee: Toyo Denso Kabushiki Kaisha, Minato-Ku Tokyo (JP)

( * ) Notice: Subject to any disclaimer, the term of this patent is extended or adjusted under 35 U.S.C. 154(b) by 137 days.

(21) Appl. No.: 11/452,700

(22) Filed: Jun. 13, 2006

(65) Prior Publication Data

US 2006/0283694 A1 Dec. 21, 2006

(30) Foreign Application Priority Data

Jun. 13, 2005 (JP) ..... 2005-200851

(51) Int. Cl.
*H01H 35/18* (2006.01)

(52) U.S. Cl. ..... 200/84 R; 200/182

(58) Field of Classification Search ..... 200/84 R, 200/182–190; 73/305, 313, 319; 116/228
See application file for complete search history.

(56) References Cited

U.S. PATENT DOCUMENTS 4,103,135 A * 7/1978 Gomez et al. ..... 200/185
5,850,175 A * 12/1998 Yeilding ..... 340/431
7,077,003 B2 * 7/2006 Tsuruoka et al. ..... 73/313

FOREIGN PATENT DOCUMENTS

JP 2000-2580 1/2000
JP 2003-184530 7/2003

* cited by examiner

*Primary Examiner*—Michael A Friedhofer
*Assistant Examiner*—Lisa N Klaus
(74) *Attorney, Agent, or Firm*—Fulbright & Jaworski

(57) ABSTRACT

A liquid level sensor switch comprising a case, a rod type guide vertically extending from an inside bottom center of the case, a float having a center bore fitted on the guide with a clearance allowing the float to freely move up and down along the guide inside the case, an electrode plate attached to a circumferential bottom surface of the float and a pair of fixed contacts disposed opposite to each other across the guide on the inside bottom surface of the case, wherein the float moves down with the drop of oil in the case along the guide to reach a lowest position at which the electrode plate makes contact with both the fixed contacts to turn on a circuit formed by the electrode plate bridging between the contacts for producing an electrical signal indicating that oil surface is lowered to or below a specified level, which is featured by using the guide having a body tapering upward from its bottom end or the float having the center bore tapered to be gradually larger in diameter upward from its bottom end to prevent the float from putting the electrode plate into poor contact with the both contacts due to variations in height of the paired contacts when the switch used in a tilted state with the float inclined aside with its center bore abutting on the guide and which is also featured by using a combination of the cylindrically formed guide and the float having a center bore having a polygonal cross section or a combination of the guide having a polygonal cross section and the float having the round center bore to prevent the float from adhering to the float to the guide due to the effect of the surface tension of oil between them when the switch is used in a tilted state.

1 Claim, 7 Drawing Sheets

LIQUID LEVEL SENSOR SWITCH

BACKGROUND OF THE INVENTION

The present invention relates to a liquid level sensor switch for electrically detecting the drop of liquid level lower than a specified level.

In general, a typical liquid level sensor switch of this kind is installed for example in an oil reservoir of a portable power generator engine so as to be actuated upon detection of the specified low level of oil in the reservoir.

A conventional liquid level sensor switch is constructed, as shown in FIG. 12. This device comprises a case 1 incorporating a rod type guide 2 vertically extending from the inside bottom of the case and a float 4 having a center bore 3 and movably mounted on the guide 2 with a gap s around the guide 2 in the float center bore so as to enable the float 4 to move up and down along the guide 2 inside the case 1. The float has an electrode plate 5 attached to the ring-shaped bottom of the float. Paired fixed contacts 6 and 7 are secured onto the inside bottom of the case 1 and disposed opposite to each other with the guide 2 between them. The float 4 moves down with the drop of oil in the case. When the float 4 moves down to put the electrode plate 5 into contact with both the paired contacts 6 and 7, the bridged contact circuit is turned on to produce an electric signal indicative of the oil level being lower than a specified level.

When the portable power generator is used on a slope, the above-described liquid level switch cannot detect the specified level of the oil because the float 4 inclines aside with its center bore 3 abutting on the side surface of the guide 2 as shown in FIG. 13 due to the presence of a gap S between the guide 4 and the center bore of the float 4 and the electrode plate 5 attached to the bottom surface of the float 4 can not get contact with one (contact 7 in the shown case) of the paired fixed contact 6, 7 having a variation $\epsilon$ in height of them.

Furthermore, when the float 4 inclines with its center round bore 3 abutting on the side surface of the guide 2, the float 4 may adhere to the guide 2 by the effect of surface tension of oil on the abutting center bore portion of the float 4 as shown in FIG. 14 and therefore it cannot smoothly move following the changing level of oil in the case.

SUMMARY OF THE INVENTION

Accordingly, an object of the present invention is to provide a liquid level sensor switch comprising a case, a rod type guide vertically extending from the inside bottom of the case, a float having a center bore loosely inserting therein the guide and freely movable up and down along the guide inside the case, an electrode plate attached to the ring-shaped bottom of the float and fixed contacts secured onto the inside bottom surface of the case to be opposite to each other with the guide between them, wherein the float moves down with the drop of oil in the case along the guide until it reaches the lowest position in which it can put the electrode plate into contact with both the fixed contacts to produce electrical signal for detecting the specified level of oil, and which is further provided with technical means for preventing incomplete contact of the electrode plate with one of the paired contacts having different heights when using the switch in the tilted state in which the float inclines aside with its center bore abutting on the side surface of the guide.

Specifically, the liquid level sensor switch according to the present invention uses the guide having a body tapered in the direction from the lower end to the top end or the float having the center bore whose diameter gradually increasing from the bottom side to the top side of the float.

The liquid level sensor switch according to the present invention is further provided with technical means for suppressing the surface tension of oil between the bore and guide when the float inclines aside with its bore abutting on the side surface of the guide.

Specifically, the liquid level sensor switch uses a combination of a cylindrically formed guide and a float having a center bore having a polygonal cross section or a combination of a guide having a polygonal cross section and a float having a round center bore.

The liquid level sensor switch according to the present invention uses a guide tapering toward the top end or a float having a center bore tapering toward the root end, which can absorb the variations in height of paired fixed contacts to assure the complete contact of an electrode plate with the both paired contacts even when the float inclines aside with its center bore abutting on the guide.

Furthermore, the liquid level sensor switch according to the present invention uses a combination of a guide having a round cross section and a float having a center bore formed of polygonal cross section or a combination of a guide having polygonal cross section and a float having a center bore formed of round cross section, wherein the float inclines aside with its center bore abutting on the guide by a small contacting surface which may reduce the effect of surface tension of oil on the contacting surface, preventing the float from adhering to the guide.

PREFERRED EMBODIMENTS OF THE INVENTION

Figure 1:
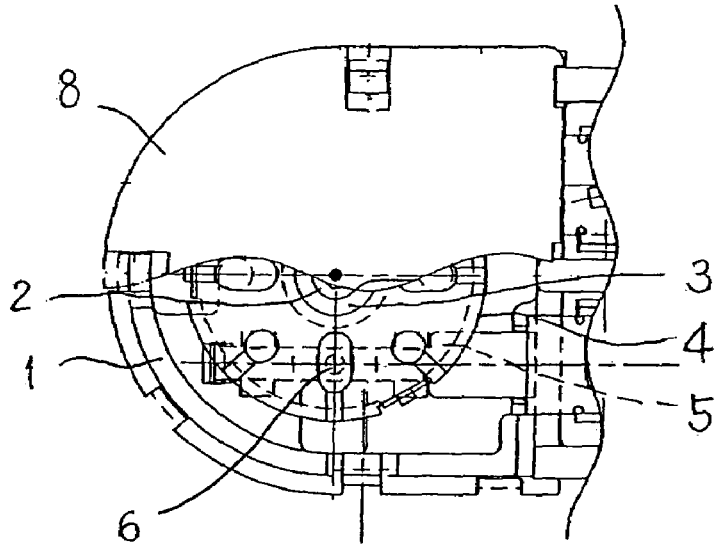
FIG. 1 is a plan view, with a case cover portion broken away, of a liquid level sensor switch according to the first embodiment of the present invention.
Figure 2:
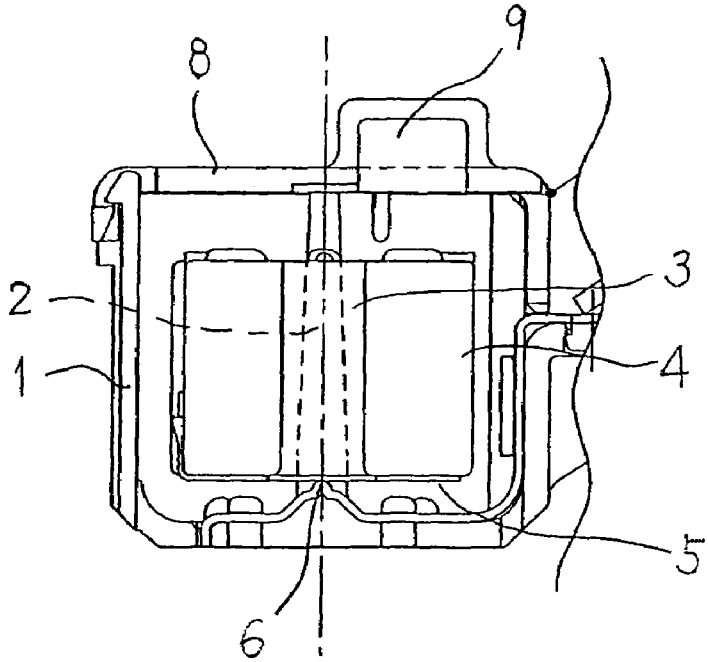
FIG. 2 is a sectional front view of the liquid level sensor switch according to the first embodiment of the present invention.
Figure 3:
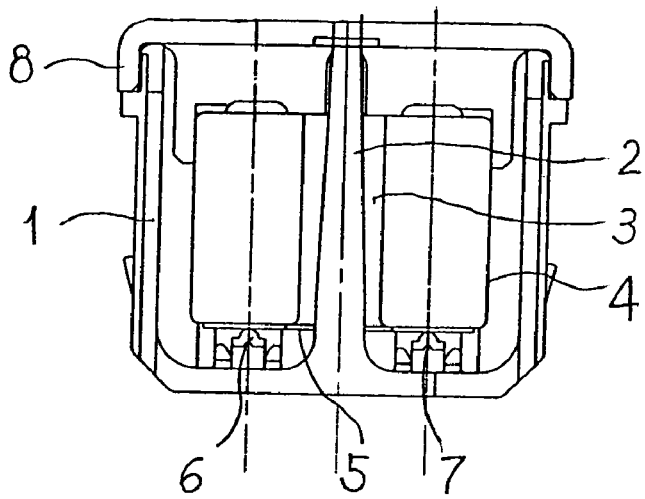
FIG. 3 is a sectional side view of the liquid level sensor switch according to the first embodiment of the present invention.

Referring to FIGS. 1 to 3, a liquid level sensor switch according to the first embodiment of the present invention comprises an open-top cylindrical case 1 formed of insulating synthetic resin, a rod type guide 2 extending upward from the center of the inside bottom of the case and a float 4 having a center bore 3 and movably mounted on the guide 2 with a gap s around the guide 2 in the center bore 3 to allow the float 4 to move up and down along the guide 2 inside the case 1. The float has an electrode plate 5 attached to its open bottom surface. Paired fixed contacts 6 and 7 are secured onto the inside bottom of the case 1 to be opposite to each other with the guide 2 between them. A case 1 is covered at its top with a case cover 8 having a window 9 formed therein for filling oil into the case.

In the liquid level sensor switch, the float 4 moves down with the drop of oil level in the case 1 until the electrode plate 5 of the float 4 makes contact with both the paired contacts 6 and 7 to turn on a bridged circuit between the contacts to output an electric signal indicating that the level of oil in the case 1 becomes lower than a specified level.

The liquid level sensor switch according to the present invention specifically adopts the guide 2 which body being gradually smaller in diameter toward its top end.

Figure 4:
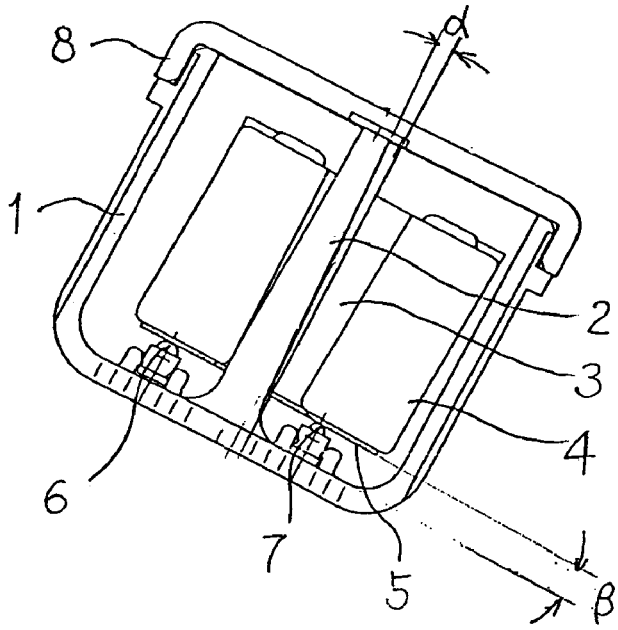
FIG. 4 is a sectional side view of the liquid level sensor switch according to the first embodiment of the present invention to illustrate the tilted state of the switch in which a float inclines aside with its center bore abutting on a guide in accordance with variations in height of paired fixed contacts.
Figure 5:
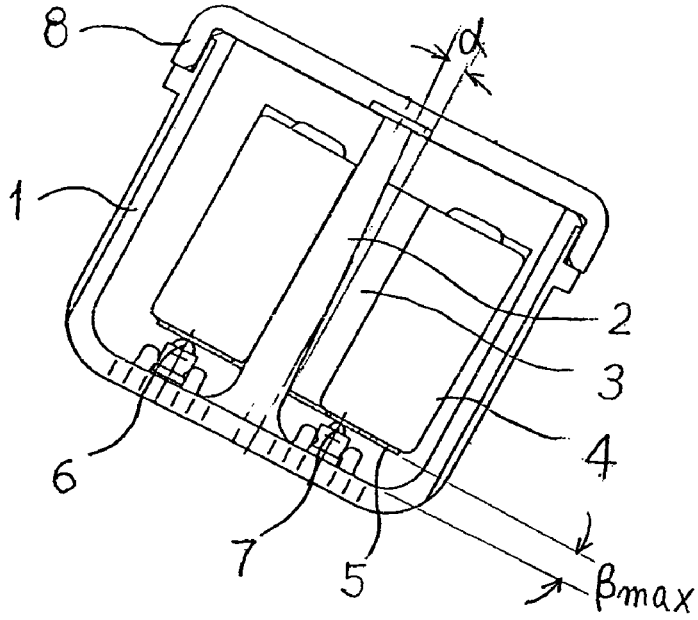
FIG. 5 is a sectional side view of the liquid level sensor switch according to the first embodiment of the present invention to illustrate the tilted state of the switch in which a float inclines aside with its center bore abutting on a guide in accordance with a maximum variation in height of paired fixed contacts.

As shown in FIGS. 4 and 5, when the switch case is tilted in the direction along the line passing through the paired fixed contacts 6 and 7, the float 4 inclines aside with its center bore abutting on the tapered surface of the guide 2 and, in this case, float 4 can tilt at an angle larger than the guide 2 by the taper angle a and can therefore bring the electrode plate 5 into contact with the both the paired contacts 6 and 7. The taper angle $\alpha$ of the guide 2 is predetermined as being larger than a maximum tilting angle $\beta$max produced by the maximum variation in height of the paired contacts 6 and 7. This can always ensure the complete contact of the electrode plate attached to the bottom of the float 4 with both the fixed paired contacts 6 and 7 to reliably detect that the liquid surface lowered to or below the specified level.

FIG. 4 shows the liquid level sensor switch used in a tilted state in which the float 4 is tilted with its center bore abutting on the tapered body of the guide 2 on the condition that an inclination angle $\beta$ of the paired fixed contacts 6 and 7, which is formed as the result of variations in height of the paired contacts 6 and 7 (the contact 7 is smaller in height than the contact 6 in the shown case) and which is smaller than the taper angle a of the guide 2.

FIG. 5 shows the liquid level sensor switch in a tilted state in which the float 4 is tilted at a maximum angle $\beta$max which is larger than the tilting angle of the guide 2 by a taper angle $\alpha$ of the guide 2 when the fixed contact 7 is smaller than the contact 6 due to variations in height of them.

Figure 6:
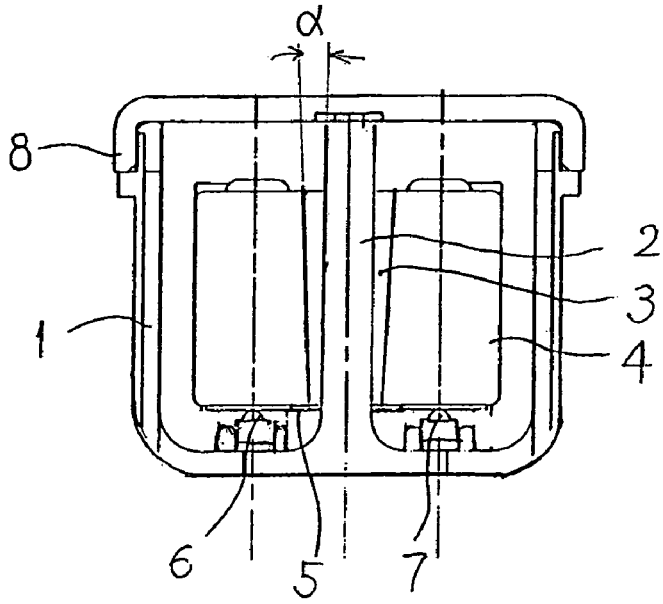
FIG. 6 is a sectional side view of a liquid level sensor switch according to the second embodiment of the present invention.

FIG. 6 shows a liquid level sensor switch according to another embodiment of the present invention, which has a rod type guide 2 with no taper on its body and a float 4 whose center bore 3 is tapered to be gradually larger in diameter upward from the open bottom of the float 4.

Figure 7:
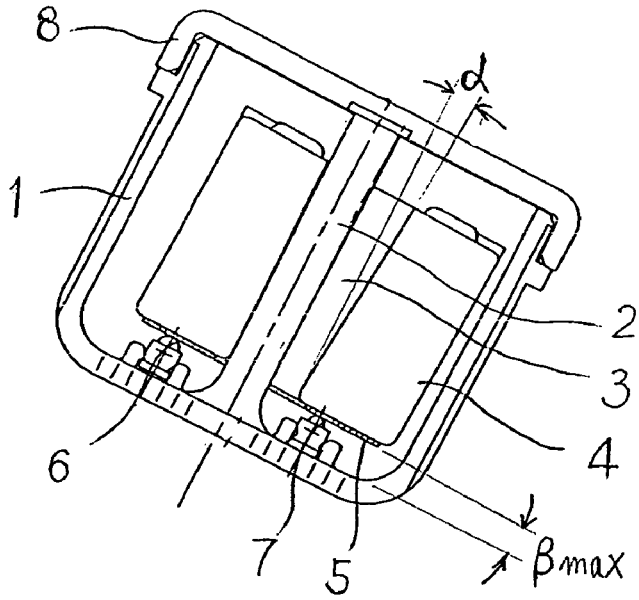
FIG. 7 is a sectional side view of the liquid level sensor switch according to the second embodiment of the present invention to illustrate the tilted state of the switch in which a float inclines aside with its center bore abutting on a guide in accordance with a maximum variation in height of paired fixed contacts.

In this embodiment, similarly with the preceding embodiment, the taper angle a of the center bore 3 of the float 4 is predetermined to be larger than the maximum inclination angle $\beta$max formed between the paired fixed contacts 6 and 7 due to a maximum variation in height of the contacts. As shown in FIG. 7, when the liquid level sensor switch is tilted in the direction along the line passing through the paired contacts 6 and 7, the float 4 inclines aside with its center bore abutting on the body of the guide 2 and puts the electrode plate 5 into contact with both the fixed contacts 6 and 7 by absorbing the variation in height of the fixed contacts 6 and 7. Thus, the liquid level sensor switch can reliably detect the specified low level of liquid by putting the electrode plate 5 into contact with both the fixed contacts 6 and 7.

Figure 8:
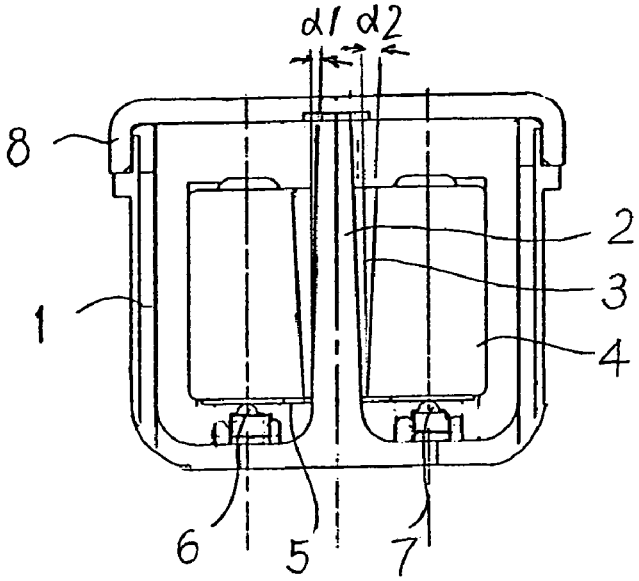
FIG. 8 is a sectional front view of a liquid level sensor switch according to the third embodiment of the present invention.
Figure 9:
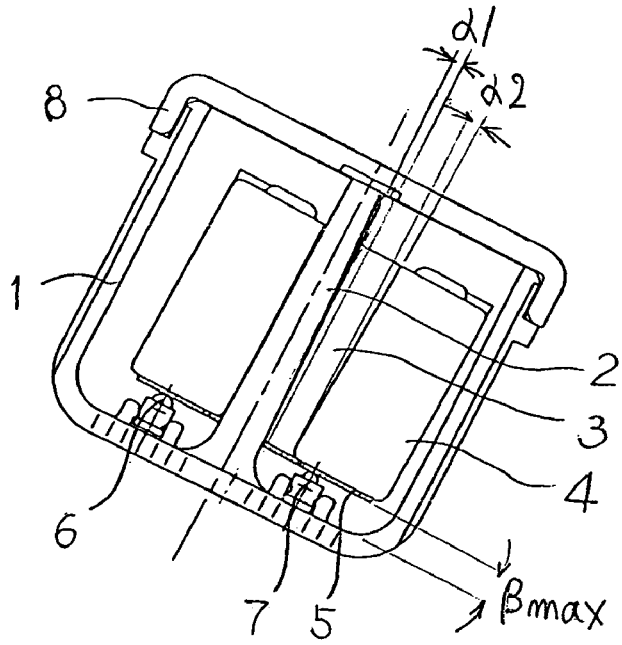
FIG. 9 is a sectional side view of the liquid level sensor switch according to the third embodiment of the present invention to illustrate the tilted state of the switch in which a float inclines aside with its center bore abutting on a guide in accordance with a maximum variation in height of paired fixed contacts.

FIG. 8 shows a liquid level sensor switch according to another embodiment of the present invention, which uses a guide 2 tapering toward the top end and a float 4 having center bore being gradually larger in diameter in cross section from the bottom to the top of the float. In this embodiment, a sum of a taper angle $\alpha$1 of the guide 2 and a taper angle $\alpha$2 of the center bore is predetermined to be larger than an inclination angle $\beta$max at the maximum variation in height of the paired fixed contacts 6 and 7. As shown in FIG. 9, when the embodiment is tilted in a direction along a line passing the paired contacts 6 and 7 and the float 4 is inclined aside with its center bore abutting on the body of the guide 2, the variation in height of the paired contacts 6 and 7 is absorbed by the total taper value of the guide 2 and the center bore 3 to enable the float 4 to further move down until the electrode plate 5 reliably makes contact with the both paired fixed contacts 6 and 7 to detect that the surface of liquid lowered below the specified level.

Figure 10:
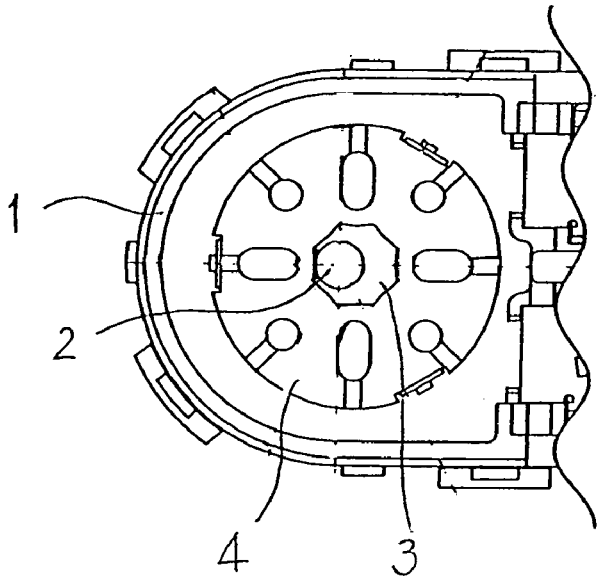
FIG. 10 is a sectional plan view of a liquid level sensor switch according to the fourth embodiment of the present invention to illustrate the tilted state of the switch in which a guide abuts against one plane of a polygonal center bore of a float.
Figure 11:
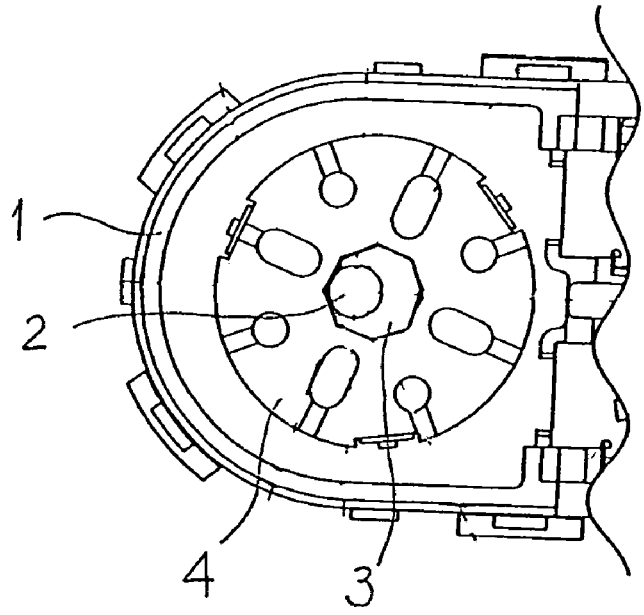
FIG. 11 is a sectional plan view of a liquid level sensor switch according to the fourth embodiment of the present invention to illustrate the tilted state of the switch in which a guide abuts against two planes of a polygonal center bore of a float.
Figure 12:
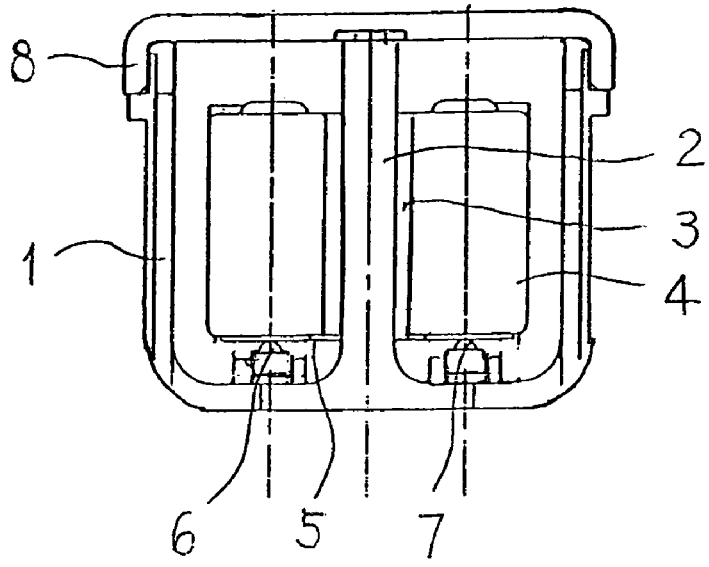
FIG. 12 PRIOR ART
FIG. 12 is a sectional side view of a conventional liquid level sensor switch.
Figure 13:
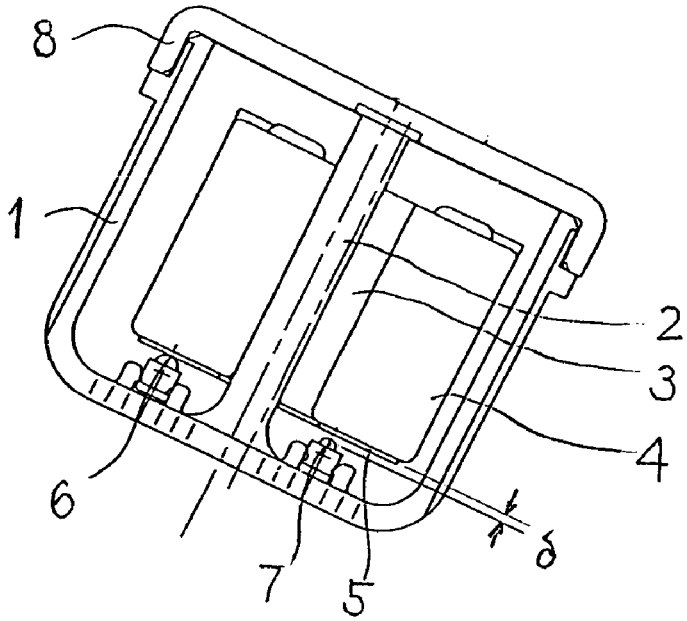
FIG. 13 PRIOR ART
FIG. 13 is a sectional side view of a conventional liquid level sensor switch to illustrate the tilted state of the switch in which a float abuts a guide.

In FIGS. 10 and 11, there is shown a liquid level sensor switch according to another embodiment of the present invention, which is featured by provision of a technical means for suppressing the surface tension of liquid, which may effect on a contact portion between the center bore 3 and the guide 2 when the float 4 inclines and abuts against the body of the guide 2.

This embodiment uses a combination of a cylindrical guide 2 and a float 4 having a center bore 3 of polygonal (e.g., octagonal) cross section as the above-mentioned technical means.

In the shown embodiment, when the guide 2 abuts against one of polygonal flat faces of the center bore 3 as shown in FIG. 10, the contact between the guide and the bore can be minimum and subjected to a minimum surface tension of liquid.

Figure 14:
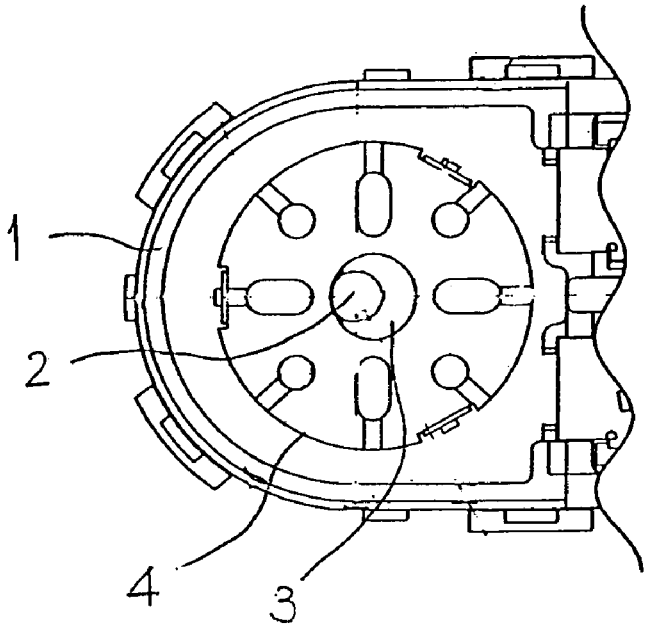
FIG. 14 PRIOR ART
FIG. 14 is a sectional plan view of a conventional liquid level sensor switch to illustrate the tilted state of the switch in which a float with round center bore abutting on a cylindrical guide.

When the guide 2 abuts against two of polygonal flat faces of the center bore 3 of the float as shown in FIG. 11, the contact area is considerably reduced as compared with that of the case (the combination of a round center bore and a cylindrical guide) shown in FIG. 14 and therefore the surface tension of liquid thereon is also reduced.

Consequently, when the float 4 inclines aside with its center 3 abutting on the guide 2, it cannot adhere to the guide by the surface tension of the liquid. The float 4 can smoothly move with a change in liquid level and can reliably detect the specified liquid level in the case.

Table 1 shows results of experiments with two groups of eight samples No. 1 to 8 of liquid level sensor switches, one group each using a combination of a cylindrical guide 2 and a float 4 having a round center bore 3 and the other group each using a combination of cylindrical guide 2 and a float 4 having octagonal center bore 3. Each sample was tested by measuring a level of oil at which the liquid level sensor switch was turned on while gradually draining oil from the case and by measuring a level of oil at which the switch was turned off while gradually refilling oil into the case. In Table 1, the differences between the measured levels (switching-ON level and switching-OFF level) are indicated as the result of the experiments with the samples.

TABLE 1

| No | With a round bore | With a octagonal bore |
|---|---|---|
| 1 | Adhered | 1.40 mm |
| 2 | 1.81 mm | 1.29 mm |
| 3 | 1.36 mm | 1.51 mm |
| 4 | Adhered | 1.32 mm |
| 5 | Adhered | 1.09 mm |
| 6 | 1.64 mm | 1.10 mm |
| 7 | 1.55 mm | 1.18 mm |
| 8 | 1.72 mm | 1.41 mm |

In the case of using a combination of a float 4 having a round center bore 3 and a guide 2 having a polygonal (e.g., octagonal) cross-section can effectively suppress the effect of surface tension of liquid on the float 4 inclined with its center bore 3 abutting on the guide 2.

As is apparent from the foregoing, the liquid level sensor switch according to the present invention, which comprises a case incorporating a rod type guide vertically extending from the inside bottom of the case and a float having a center bore and movably mounted on the guide with a gap around the guide in the center bore for moving up and down along the guide with the rise and drop of liquid level in the case, an electrode plate 5 attached to the bottom surface of the float and paired fixed contacts secured to the inside bottom of the case in opposition to each other with the guide between them and which turns ON upon the detection of the specified low level of liquid in the case when float 4 reaches its low-level position with the electrode plate putted in contact with both the paired contacts, wherein the switch adopts the guide tapering upward from its bottom end or/and the float having a center bore being gradually larger in diameter from the bottom to the top and a combination of the cylindrical guide and the float having its polygonal center bore or a combination of the guide having polygonal cross section and the float having its round center bore. By the provision of the above-described simple technical means, the liquid level sensor switch according to the present invention can effectively operate in a tilted state with the float being inclined with its center bore abutting on the guide body with no fear of incomplete contact of the electrode plate with the paired fixed contacts due to variations in height of the contacts and no fear of adhering the float to the guide due to the effect of surface tension of liquid, thus offering the advantages in wide industrial applications.

The invention claimed is:

1. A liquid level sensor switch, comprising a case, a rod type guide vertically extending upward from an inside bottom center of the case, a float having a center bore loosely inserting therein the guide, said float being movable up and down along the guide, an electrode plate attached to a bottom surface of the float, and a pair of fixed contacts disposed opposite to each other across the guide on the inside bottom surface of the case, wherein the float moves down with the drop of liquid in the case until reaching a specified lowest position at which the electrode plate makes contact with both the paired contacts to turn on a circuit formed by the electrode plate bridged between the paired contacts for detecting a specified low level of liquid, characterized in that the guide has a body tapered to be gradually smaller in diameter in cross section upward from its bottom end.

* * * * *